US007677356B2

(12) United States Patent
Yang

(10) Patent No.: US 7,677,356 B2
(45) Date of Patent: Mar. 16, 2010

(54) ACOUSTIC MATERIAL AND METHOD FOR MAKING THE SAME

(75) Inventor: Tsung-Lung Yang, Taipei Hsien (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 597 days.

(21) Appl. No.: 11/555,662

(22) Filed: Nov. 1, 2006

(65) Prior Publication Data

US 2007/0123676 A1 May 31, 2007

(30) Foreign Application Priority Data

Nov. 25, 2005 (TW) ..... 94141489 A

(51) Int. Cl.

| | |
|---|---|
| ***H04R 7/10*** | (2006.01) |
| ***H04R 7/06*** | (2006.01) |
| *G10K 13/00* | (2006.01) |
| *H04R 7/02* | (2006.01) |

(52) U.S. Cl. ..... 181/169; 181/167; 381/426; 381/428

(58) Field of Classification Search ..... 181/169, 181/167, 170; 381/426, 428

See application file for complete search history.

(56) References Cited

U.S. PATENT DOCUMENTS

| | | | | | |
|---|---|---|---|---|---|
| 3,914,501 | A | * | 10/1975 | Miller et al. | 442/350 |
| 4,582,163 | A | * | 4/1986 | Catthoor | 181/169 |
| 5,064,890 | A | | 11/1991 | Hidekazu et al. | |
| 5,098,976 | A | | 3/1992 | Uryu et al. | |
| 5,776,380 | A | * | 7/1998 | Baigas, Jr. | 261/107 |
| 5,875,253 | A | * | 2/1999 | Okazaki et al. | 381/396 |
| 2004/0198125 | A1 | * | 10/2004 | Mater et al. | 442/394 |
| 2006/0160454 | A1 | * | 7/2006 | Handermann et al. | 442/415 |

FOREIGN PATENT DOCUMENTS

| | | |
|---|---|---|
| JP | 6-212545 | 8/1994 |
| JP | 8-246313 | 9/1996 |

* cited by examiner

*Primary Examiner*—Edgardo San Martin
(74) *Attorney, Agent, or Firm*—Frank R. Niranjan

(57) ABSTRACT

An acoustic material includes at least a kind of synthetic staple fiber and a kind of low melting point fiber having a melting point lower than that of the at least one kind of synthetic staple fiber. Method for making the acoustic material includes the following steps: a) blending the synthetic staple fiber with the low melting point fiber together; b) cross lapping the mixed fibers to a predetermined thickness; c) drying the fibers to bond the fibers together.

15 Claims, 5 Drawing Sheets

ACOUSTIC MATERIAL AND METHOD FOR MAKING THE SAME

BACKGROUND OF THE INVENTION

1. Field of the Invention

The present invention relates generally to an acoustic material employed as a diaphragm of an electroacoustic device, and more particularly to a method for manufacturing the acoustic material.

2. Description of Related Art

Sound is one important means by which people communicate with each other, thus creating new methods for sound transference allows greater communication between people. Electroacoustic transducers are key components in transferring sound. A typical electroacoustic transducer has a magnetic circuit in which a magnetic field generated by a magnet passes through a base member, a magnetic core and a diaphragm and returns to the magnet again. When an oscillating electric current is supplied to a coil wound around the magnetic core, the corresponding oscillating magnetic field generated by the coil is then superimposed onto the static magnetic field of the magnetic circuit. The resulting oscillation generated in the diaphragm is then transmitted to the air as sound. The basic loudspeaker, in which electric energy is converted to acoustic energy, is a typical electroacoustic transducer. There are many different types of loudspeakers, including electrostatic loudspeakers, piezoelectric loudspeakers, and moving-coil loudspeakers.

Nowadays, mobile phones are widely used and loudspeakers are important components packaged within mobile phones. As design style for mobile phones emphasizes lightness, smallness, energy-efficiency, low cost, the space available for loudspeakers within mobile phones is therefore limited. Furthermore, as more and more mobile phones are being used to play MP3s, the rated power of the loudspeakers needs to increase. The space occupied by loudspeakers mainly depends on maximum deformation displacement of a diaphragm of the loudspeaker.

Therefore, it is desired to design a new diaphragm for micro-electroacoustic transducers having low density and high modulus of elasticity, thus enhancing the reproduction frequency range.

SUMMARY OF THE INVENTION

According to a preferred embodiment of the present invention, an acoustic material which can be employed as a diaphragm of an electroacoustic device includes at least one kind of synthetic staple fiber and a kind of low melting point fiber having a melting point lower than that of the at least one kind of synthetic staple fiber. Method for making the acoustic material includes the following steps: a) blending the at least one synthetic staple fiber with the low melting point fiber together; b) cross lapping the mixed fibers to a predetermined thickness; c) drying the fibers to bond the fibers together.

Other advantages and novel features of the present invention will become more apparent from the following detailed description of preferred embodiment when taken in conjunction with the accompanying drawings, in which:

DETAILED DESCRIPTION OF THE INVENTION

Figure 1:
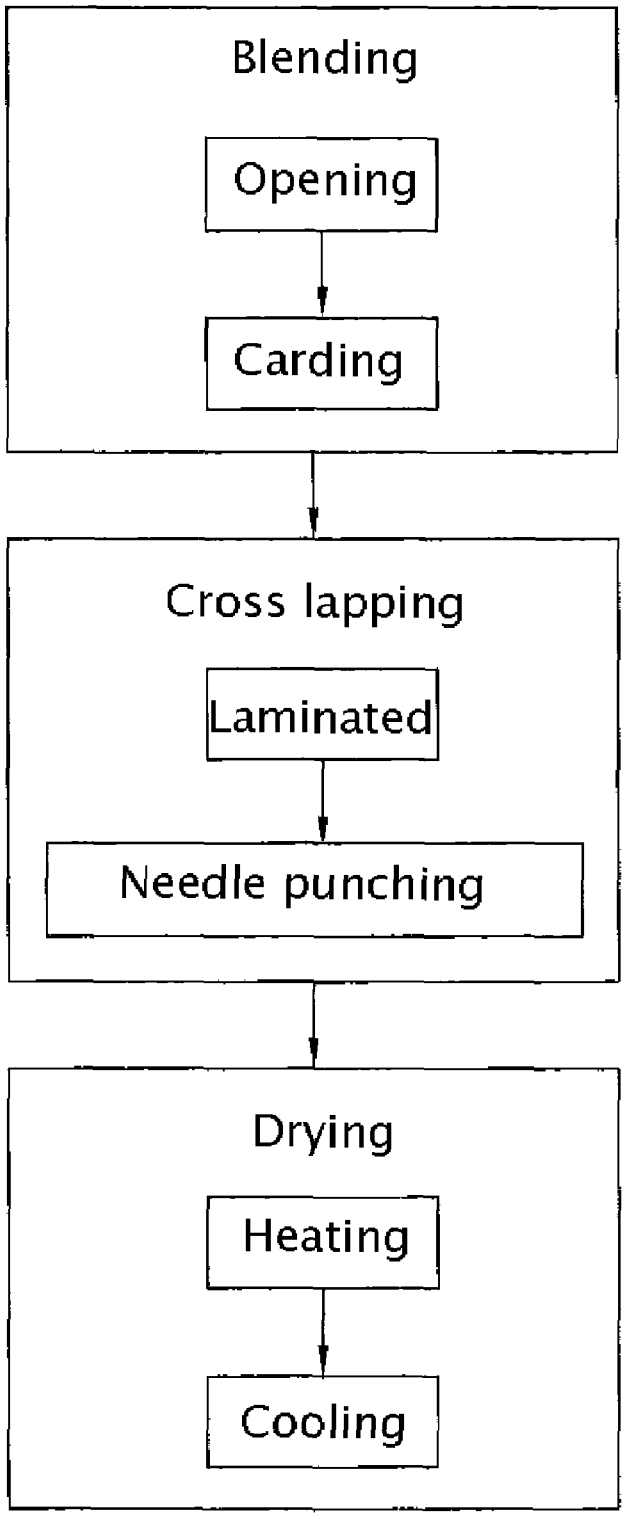
FIG. 1 is a flow chart of a preferred method in accordance with the present invention, for manufacturing an acoustic material applicably employed as a diaphragm of an electroacoustic device.

FIG. 1 shows a preferred method in accordance with the present invention for producing an acoustic material which can be employed as a diaphragm of an electroacoustic device, such as a loudspeaker. The acoustic material is obtained by several kinds of fibers mixed together, and a plurality of processes is required to bond the fibers together to form the acoustic material.

The acoustic material includes at least one kind of synthetic staple fiber, and a kind of low melting point fiber. The melting point of the low melting point fiber is lower than that of the synthetic staple fiber. For enhancing the surface finish of the acoustic material and the convenience for producing of the acoustic material, a little of superfine fiber which is not larger than 0.3 fiber number can be added to the acoustic material. The "fiber number" used herein represents a size of the fiber. An average diameter of the fiber of 0.3 fiber number is about 0.5 μm. Alternatively, non-woven fiber or flame retardant superfine fiber can be added to the acoustic material to enhance the surface finish of the acoustic material. The synthetic staple fiber is used to absorb energy of the sound. The synthetic staple fiber is synthetic polyester fiber. The low melting point fiber is used to bond the fibers together, and may be selected from Polyethylene (PE), polyethylene terephthalate (PET), polypropylene (PP) or the like. An average diameter of the low melting point fiber is in range of 1 μm to 50 μm. The synthetic staple fiber and the low melting point fiber are greater than the superfine fiber in diameter. Each kind of the fibers has an average diameter different from that of the other fibers to enhance a range of the frequency of the sound absorbed by the acoustic material.

As shown in FIG. 1, firstly a fiber blending process is used to mix the fibers which are required for producing the acoustic material together. In this embodiment, the acoustic material is made from a kind of synthetic staple fiber, a kind of low melting point fiber and a kind of superfine fiber. The three kinds of fibers are synthetic polyester fiber. An average diameter of the synthetic staple fiber is about 9.1 μm, and an average diameter of the low melting point fiber is about 14.4 μm. A ratio of the synthetic staple fiber to the acoustic material is in range of 65~95% in weight. A ratio of the low melting point fiber to the acoustic material is in range of 5~35% in weight, and a ratio of the superfine fiber to the acoustic material is in range of 0~0.1% in weight.

The blending process includes a fiber opening step and a fiber carding step. The three kinds of fibers are evenly dispersed and distributed during the opening process. The carding process blends the fibers thoroughly throughout. Thus the three kinds of fibers of different sizes and textures are blended complete, and are lamellar-shaped. Then cross lapping process is used to laminate the fibers to a predetermined thickness. The lamellar-shaped fibers are laminated to the predetermined thickness and then sewed together using a needle punching step. Thus the fibers are laminated to the predetermined thickness and are fixed together. Finally the fibers are put through a drying process to bond themselves together.

Firstly, the fibers are heated under a temperature in a range from 100~200° C. for 5 seconds to 40 minutes. The low melting point fiber intenerates to agglutinate the fibers together. The temperature and time for heating the fibers is determined by the thickness of the fibers. The thickness of the fibers is larger, the temperature needed is higher, and the time needed for the drying process is longer. Then cooling the fibers under the ambient temperature for 5 seconds to 40 minutes to obtain the acoustic material. For enhancing the surface finish, a cooling calendaring or hot calendaring process can be applied to the acoustic material. In the drying process, a little of non-woven fiber or flame retardant fiber, is added for enhancing the surface finish of the acoustic material and the convenience of producing the acoustic material.

Figure 2:
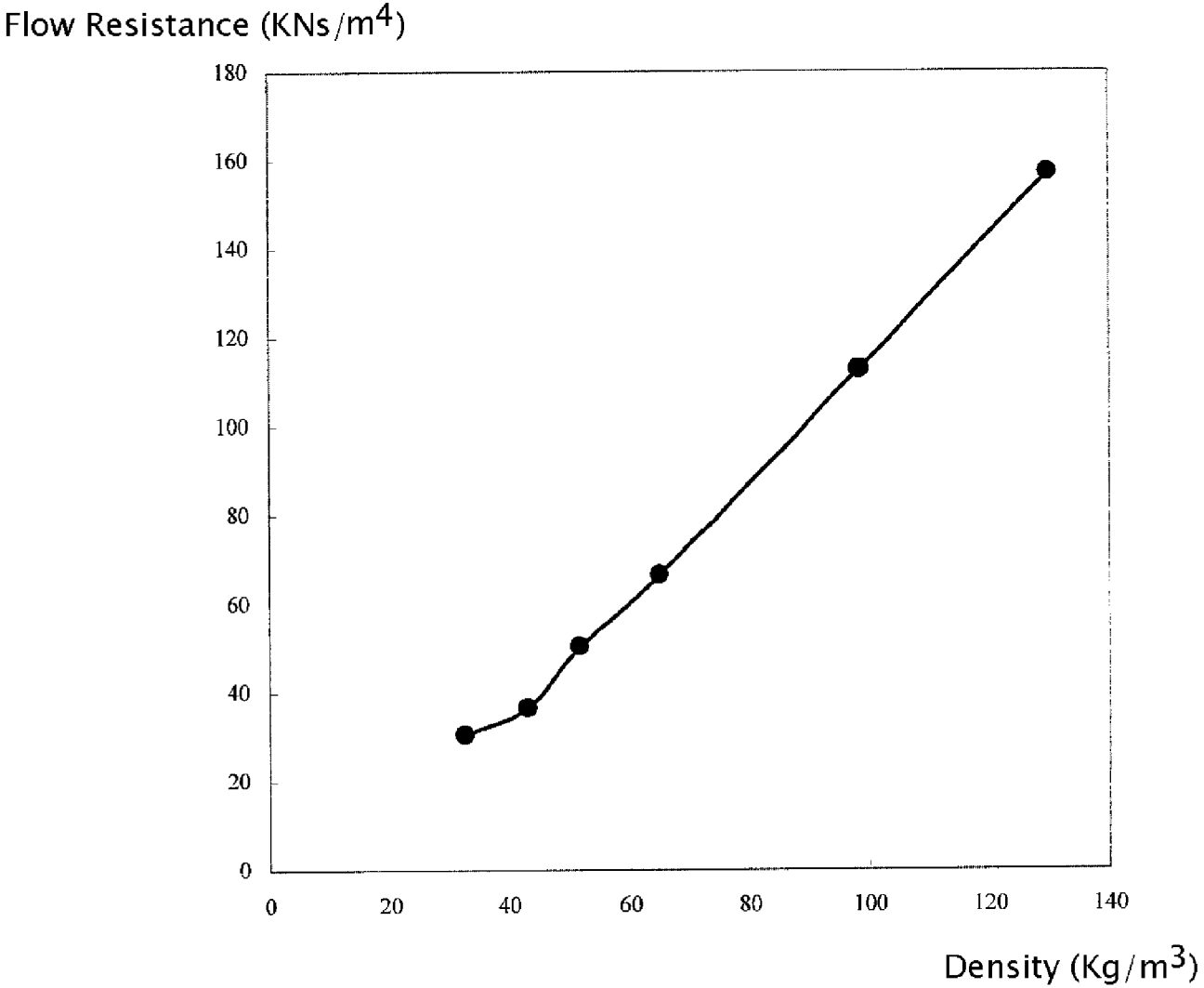
FIG. 2 is a graph indicating relation between a flow resistance and a density of the acoustic material.

The present acoustic material is obtained by several different kinds of fibers bonding together. Each kind fiber has a reproduction frequency range different from that of the others for the different size thereof. Thus the reproduction frequency range of the acoustic material is widened. The acoustic material can be constructed in different thicknesses, sizes, shapes, etc. Also a density of the acoustic material can be changed by changing the content or the sort of the fibers in the acoustic material. For satisfying lightless requirement of the electroacoustic device, a preferred density of the acoustic material is in range of 1~250 kg/m$^3$. FIG. 2 shows flow resistances of the acoustic materials of different densities. The thicknesses of the acoustic materials are the same which are about 10 mm. The flow resistance of the acoustic material having a density about 32.5 kg/m$^3$ is about 33 KNs/m$^4$. The flow resistance of the acoustic material increases with the density of the acoustic materials. Acoustic materials having densities of 43.3, 52, 65, 98 and 130 kg/m$^3$ have flow resistances of 38, 53, 70, 116 and 162 KNs/m$^4$, respectively.

Figure 3:
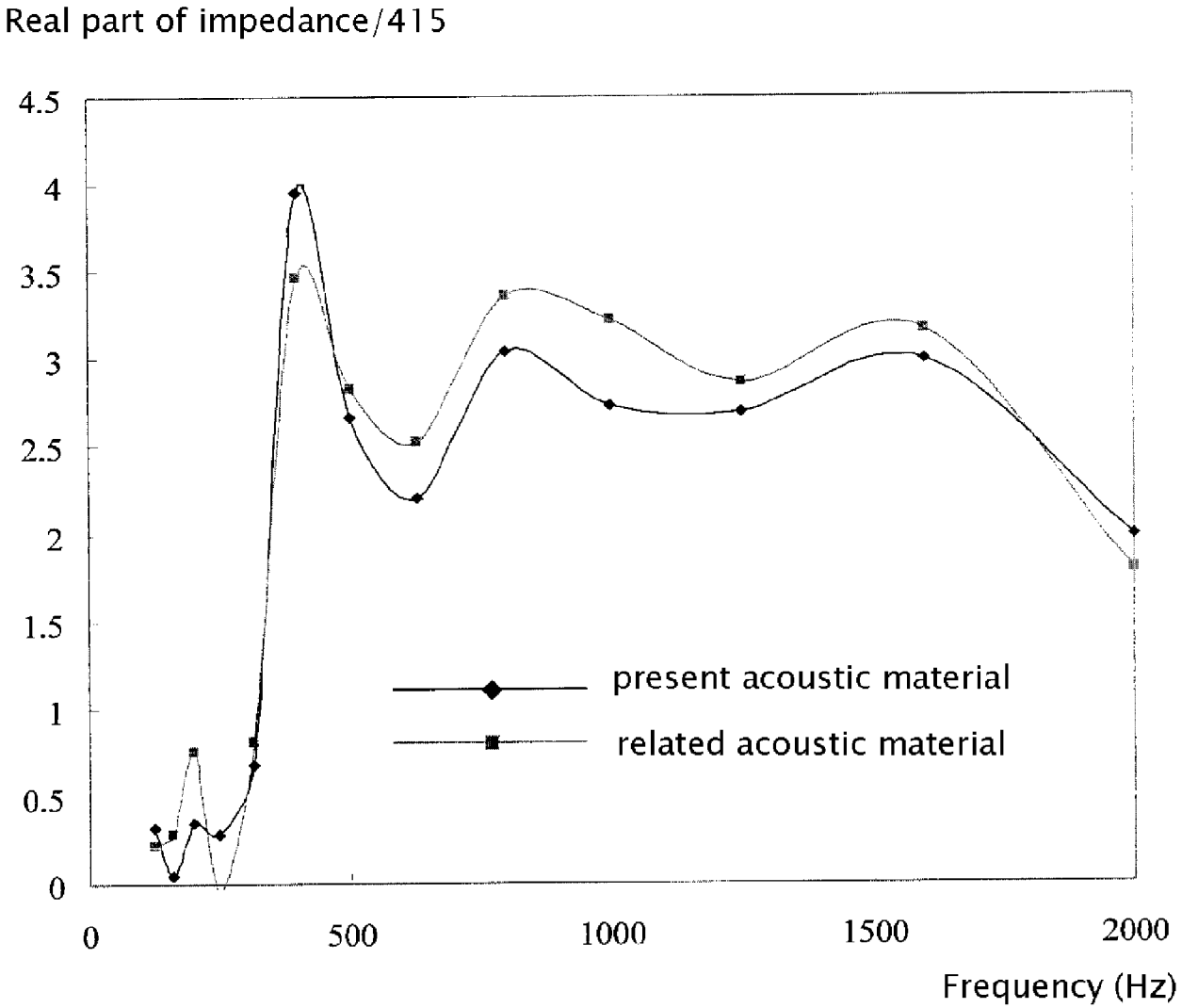
FIG. 3 is a graph indicating real impedances of the present acoustic material and a related acoustic material.
Figure 4:
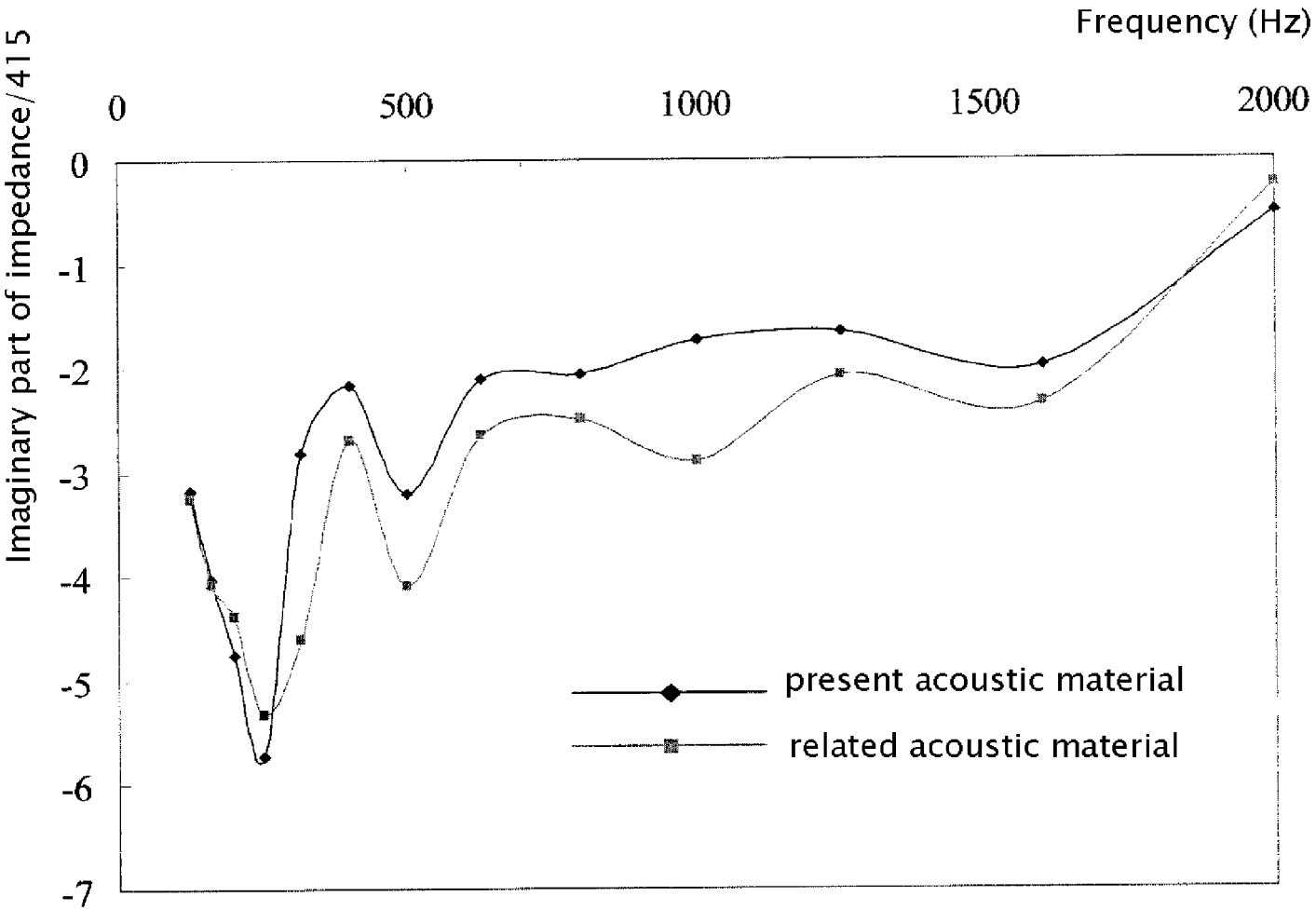
FIG. 4 is similar to FIG. 3, but shows simulated impedances of the two acoustic materials.
Figure 5:
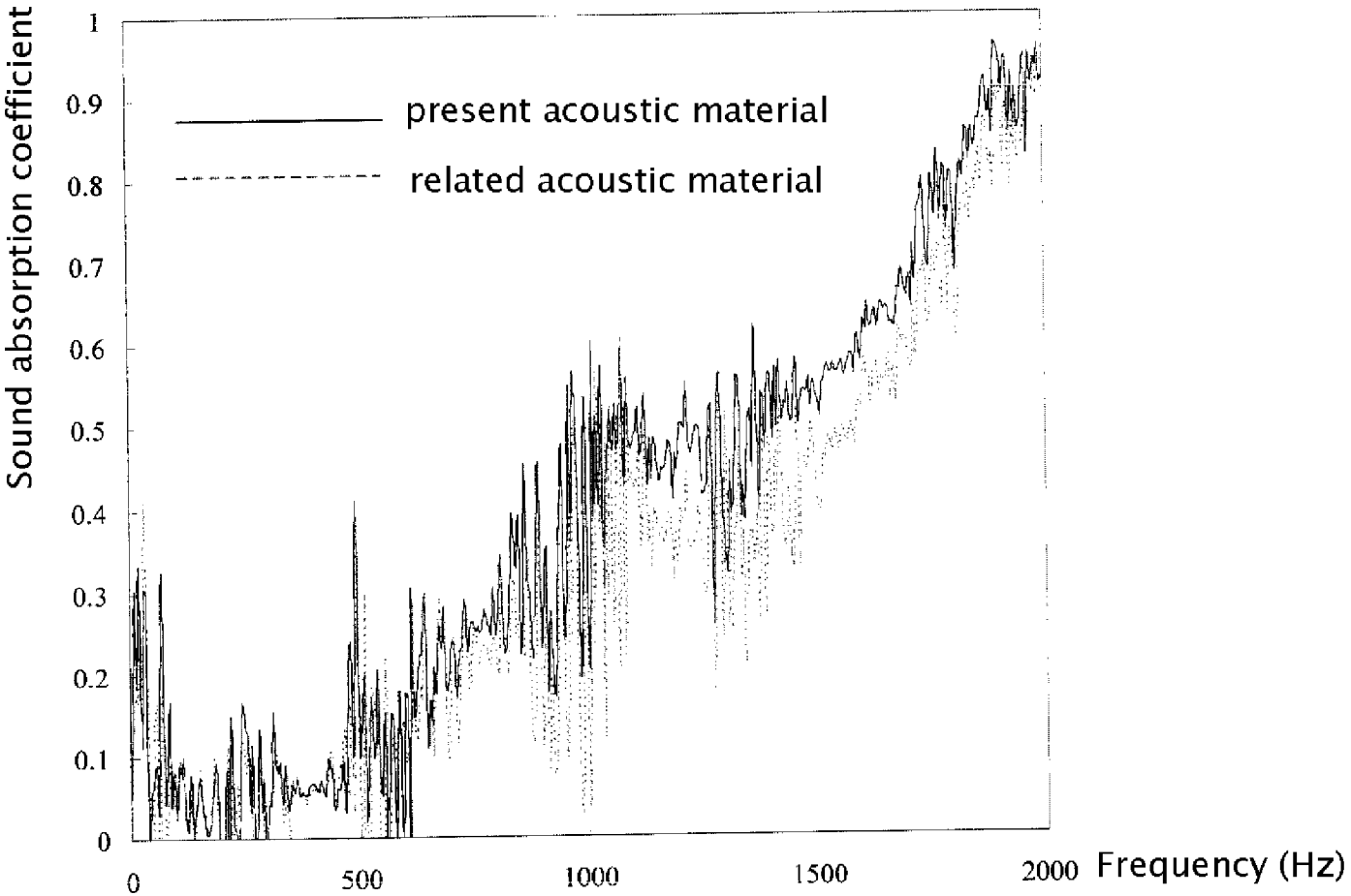
FIG. 5 is a graph indicating sound absorption coefficients of the present acoustic material and a related acoustic material.

FIGS. 3-4 show impedances of a present acoustic material and a related acoustic material. FIG. 3 shows real parts of the impedances, and FIG. 4 shows imaginary parts of the impedances of the acoustic materials. The impedances of the two materials are similar to each other. A thickness of each of the two materials is about 10 mm. However, a density of the related acoustic material is about 210 kg/m$^3$, whilst a density of the present acoustic material is much smaller than that of the related acoustic material, which is just about 98 kg/m$^3$. FIG. 5 shows sound absorption coefficients of the present acoustic material and the related acoustic material. The sound absorption coefficient of the present acoustic material is a little larger than that of the related acoustic material. Thus the present acoustic material has a weight much smaller than the related acoustic material, but has the same sound absorption coefficient and impedance as the related acoustic material. A diaphragm for electroacoustic transducers made of the present acoustic material has low density and high modulus of elasticity, and hence enhancing the reproduction frequency range of the micro-electroacoustic devices.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for making an acoustic material for use as a diaphragm of an electroacoustic device comprising the following steps:

providing at least one kind of synthetic staple fiber and a kind of low melting point fiber having a melting point lower than that of the at least one kind of synthetic staple fiber;

blending the fibers together;

cross lapping the mixed fibers to a predetermined thickness; and drying the fibers to bond the fibers together;

wherein during the drying process one of the following materials: superfine fiber, non-woven fiber and flame retardant fiber, which has a ratio not more than 0.1% to the acoustic material in weight and an average diameter not larger than 0.5 μm, is added to the acoustic material.

2. The method of claim 1, wherein the blending process comprises a fiber opening step and a fiber carding step.

3. The method of claim 1, wherein the cross lapping process comprises a laminated step and a needle punching step.

4. The method of claim 1, wherein the drying process comprises a heating step and a cooling step.

5. The method of claim 4, wherein the heating step is under a temperature in range of 100~200° C. for 5 seconds to 40 minutes, and the cooling step is under ambient temperature for 5 seconds to 40 minutes.

6. The method of claim 1, wherein a ratio of the at least one kind of synthetic staple fiber to the acoustic material is in range of 65~95% in weight.

7. The method of claim 1, wherein a ratio of the low melting point fiber to the acoustic material is in range of 5~35% in weight.

8. An acoustic material for being employed as a diaphragm of an electroacoustic device, comprising:

at least one kind of synthetic staple fiber;

a kind of low melting point fiber having a melting point lower than that of the at least one kind of synthetic staple fiber; and one of the following materials: superfine fiber, non-woven fiber and flame retardant fiber, which has a ratio not more than 0.1% to the acoustic material in weight.

9. The acoustic material of claim 8, wherein a ratio of the at least one kind of synthetic staple fiber to the acoustic material is in range of 65~95% in weight.

10. The acoustic material of claim 8, wherein the low melting point fiber and the at least one kind of synthetic staple fiber are synthetic polyester fiber.

11. The acoustic material of claim 10, wherein the low melting point fiber is selected from one of the following materials: Polyethylene, polyethylene terephthalate and polypropylene.

12. The acoustic material of claim 8, wherein an average diameter of the low melting point fiber is in a range of 1~50 μm.

13. The acoustic material of claim 8, wherein each of the superfine fiber, the non-woven fiber and the flame retardant fiber has an average diameter not larger than 0.5 μm.

14. The acoustic material of claim 8, wherein the acoustic material has a density in range of 1~250 kg/m$^3$.

15. The acoustic material of claim 8, wherein a ratio of the low melting point fiber to the acoustic material is in range of 5~35% in weight.

* * * * *